US007086950B2

(12) United States Patent
Gordon et al.

(10) Patent No.: US 7,086,950 B2
(45) Date of Patent: Aug. 8, 2006

(54) CUCKOO CLOCK GAMING DEVICE

(76) Inventors: Stephen Eugene Gordon, 9429 Silvaner Ct., Las Vegas, NV (US) 89123; Kenneth Walter Peek, 8543 Ocotillo Springs Cir., Las Vegas, NV (US) 89147

( * ) Notice: Subject to any disclaimer, the term of this patent is extended or adjusted under 35 U.S.C. 154(b) by 552 days.

(21) Appl. No.: 09/968,996

(22) Filed: Oct. 3, 2001

(65) Prior Publication Data

US 2003/0064806 A1 Apr. 3, 2003

(51) Int. Cl.
*A63F 9/24* (2006.01)

(52) U.S. Cl. ..... 463/42; 463/47

(58) Field of Classification Search ..... 463/16, 463/20–24, 42, 46–47; 710/3, 8–20, 35, 710/62–64

See application file for complete search history.

(56) References Cited

U.S. PATENT DOCUMENTS

| | | | | |
|---|---|---|---|---|
| 5,380,008 | A | 1/1995 | Mathis et al. | |
| 5,908,354 | A | 6/1999 | Okuniewicz | |
| 6,071,190 | A | 6/2000 | Weiss et al. | |
| 6,089,980 | A | 7/2000 | Gauselmann | |
| 6,117,010 | A | 9/2000 | Canterbury et al. | |
| 6,126,542 | A | 10/2000 | Fier | |
| 6,135,884 | A | 10/2000 | Hendrick et al. | |
| 6,251,014 | B1 * | 6/2001 | Stockdale et al. | 463/16 |
| 6,270,415 | B1 * | 8/2001 | Church et al. | 463/40 |
| 6,394,900 | B1 * | 5/2002 | McGlone et al. | 463/20 |
| 6,488,585 | B1 * | 12/2002 | Wells et al. | 463/43 |

* cited by examiner

*Primary Examiner*—Kim Nguyen
(74) *Attorney, Agent, or Firm*—Siemens Patent Services, LC

(57) ABSTRACT

There is provided a universal serial interconnection strategy which allows individual internal gaming machine components, sub-assemblies and sub-systems to be connected to a controller. Each component bears a globally unique identification number (GUIN) which allows the controller to recognize, enumerate and authenticate the device and to reconfigure itself or another programmable component of the gaming machine for proper communication with the device having the particular GUIN. In addition to internal gaming machine components, external components such as secondary or tertiary games may also be connected to a controller within a gaming machine to which the games are attached. The universal serial interconnection strategy of the invention thereby provides a "Plug-and-Play" (PNP) style interface which can eliminate the point-to-point interconnection of gaming machine components used in gaming machine of the prior art.

4 Claims, 7 Drawing Sheets

CUCKOO CLOCK GAMING DEVICE

FIELD OF THE INVENTION

The present invention relates to gaming machines and, more particularly to interconnecting either internal or external gaming machine components, sub-systems, or secondary games.

BACKGROUND OF THE INVENTION

Gaming machines typically consist of a composite of original equipment manufacturer (OEM) components and so-called "third party" components. Typical components generally include: a controller/computation unit, a bill acceptor, a coin hopper, a coin comparator; low-voltage button lights, low-voltage button push detectors, reels, reel drivers, one or more video monitors. In addition, components such as player tracking systems, ticket printers, fiduciary and/or secondary displays, etc., may also be added to a gaming machine, either internally or external to the machine.

Heretofore, each manufacturer of gaming machines has followed a vertically organized strategy for building their machines. Each manufacturer typically builds some of the necessary machine components and purchases others. Each machine design is generally a one-of-a-kind design with proprietary interconnection of the necessary machine components. Because of the fact that each gaming machine component typically has a proprietary electrical and communication interface, the resulting machines are a chaotic collection of point-to-point wiring, mechanical and software designs.

There are many disadvantages to this approach of the prior art. For example, as new gaming machines are designed, the "wheel" has typically been reinvented. Little of previous machine designs is re-usable in the new design. That is not only costly from both an engineering and manufacturing perspective, it also means that various regulatory and oversight agencies involved in monitoring the gaming industry must always start from scratch in their analysis of a new gaming machine design.

In the gaming industry it is not uncommon to purchase third-party add-on components for after-market installation either within a gaming machine or, as is the case with a secondary game, external to the original gaming machine. Because, heretofore, there has been little standardization within the industry, each after market component typically needs to be adapted to work with only a single machine or group of machines from a gaming machine manufacturer. A third-party manufacturer of such add-on components needs to have several versions available to service the range of machines deployed in the gaming parlors, casinos, etc. Again, this is costly and may lead to complications with the regulatory authorities.

Many of these types of problems are overcome by the universal serial interface/"plug and play" strategy of the present invention. A universal serial interface is provided for interconnection of both internal and external machine components. Each component is assigned a "Globally Unique Identification Number (GUIN) which positively identifies that component, sub-assembly, or game. A controller equipped with the necessary definition and configuration information both recognizes and establishes proper communications with each component, machine sub-system, or complete machine present on the serial network. This, in effect, establishes an interface strategy not unlike the ubiquitous "plug-and-play", (or as it is often abbreviated, "PNP") strategy used in the personal computer industry. The implication of this approach is that machine components and/or sub-systems may potentially be certified once and then re-used as required in numerous different machine designs. New machines could be more quickly designed, evaluated, certified and marketed. Third party vendors could produce only a single, universal version of their components, sub-systems or add-on machines.

DISCUSSION OF THE PRIOR ART

U.S. Pat. No. 5,380,008 for ELECTRONIC GAMING APPARATUS, issued Jan. 10, 1995, to Ricard M. Mathis, et al., teaches an electronic gaming machine using a central microprocessor (μP) 52 (FIG. 2) connected by bi-directional serial links to a hopper driver μP 56 and a door μP 54. However, all other components (e.g., reel drivers 58a, etc.) appear to be interconnected using conventional point-to-point wiring strategies.

In contradistinction, the universal serial interconnection strategy of the invention provides electrical communication between substantially all of the internal components of a gaming machine. Secondary games, or the like, may also be connected to the gaming machine for interaction therewith by means of the universal serial interconnection. A PNP like strategy provides universal interconnectability between components from different manufacturers. MATHIS, et al. neither teach nor suggest the possibility of a universal serial interconnection strategy nor a PNP type of automatic configuration system.

U.S. Pat. No. 5,908,354 for PROGRAMMABLE SOUND CARD FOR ELECTRONIC DEVICES, issued Jun. 1, 1999, to Douglas M. Okuniewicz, teaches a sound card specifically designed for use as a component of a gaming machine. This programmable sound card is specifically designed so that sounds may be reprogrammed without introducing any change in the card which could in any way effect the outcome of the gaming machine within which the card is installed. While information could be transferred from a "main board" in the gaming machine via a serial interface, there is no teaching or suggestion of a universal serial interface to which devices such as the OKUNIEWICZ sound card could be connected. Neither is there any teaching of a PNP type of automatic configuration strategy.

U.S. Pat. No. 6,071,190 for GAMING DEVICE SECURITY SYSTEM: APPARATUS AND METHOD, issued Jun. 6, 2000, to Steven A. Weiss, et al., teaches an internal gaming machine architecture wherein processing is performed in two portions, a secure portion and a non-secure portion. The secure portion features unalterable memory and other security provisions while the non-secure portion allows normal writes to the memory. A serial interconnection is provided between the two portions for the transmission of encrypted data therebetween. Unlike the instant invention, there is no teaching of a universal, PNP type serial strategy for interconnecting internal machine components and automatically configuring a processor to recognize and communicate with each component connected to the inventive serial bus.

U.S. Pat. No. 6,089,980 for METHOD FOR THE DETERMINATION OF A SHARED JACKPOT WINNING, issued Jul. 18, 2000, to Michael Gauselmann teaches a method for interconnecting at least two gaming machines interactively such that the payout is jointly filled from these multiple, interconnected machines. GAUSELMANN teaches an architecture for each machine including a main processor board 11 (FIG. 2) and a communications board 10. Multiple serial interfaces, for example 15, 22, 25, 30, etc. are shown. Each of these serial ports is, however, dedicated to a particular task and the primary elements such as the coin unit 12, payout unit 5, and the operable components 13 are not connected to any of these serial interfaces. Also, GAUSELMANN teaches no PNP-type automatic configuration feature.

U.S. Pat. No. 6,117,010 for GAMING DEVICE WITH SERIAL CONNECTION, issued Sep. 12, 2000, to Stephen A. Canterbury, et al., teaches the use of a serial connection 70 between a game control unit 68 and a micro controller 66. Micro controller 66 is shown connected to a plurality of lights 60 and switches 74. Consequently, serial link 70 comprising a single cable can replace multiple cables or a multi-conductor cable previously required between the game controller 68 and the plurality of switches 64 and lamps 60. CANTERBURY, et al., fail to disclose either a serial topology for interconnecting most other internal gaming machine components (e.g., coin hopper, reel motors, payout unit, etc.). Neither do CANTERBURY, et al., disclose a PNP like automatic component configuration system.

U.S. Pat. No. 6,126,542 for GAMING DEVICE AND METHOD FOR OFFERING PRIMARY AND SECONDARY GAMES, issued Oct. 3, 2000, to Robert B. Fier teaches a method for integrating a secondary game with a primary game. A secondary game is initiated when a player reaches a predetermined trigger point while playing the primary game. FIER, however, provides no details of any electrical interconnections between a primary and a secondary game.

U.S. Pat. No. 6,135,884 for GAMING MACHINE HAVING SECONDARY DISPLAY FOR PROVIDING VIDEO CONTENT, issued Oct. 24, 2000, to Joseph. R. Hedrick, et al., teaches the use of a proprietary internal serial interconnection (i.e., "Netplex") for interconnecting a game CPU 502 and a "multislave" unit 508. HEDRICK, et al., show no generalized, universal serial interconnection strategy for connecting individual internal gaming machine components. Neither is there any teaching of a PNP like automatic configuration method.

None of these patents either teaches or suggests the possibility of using a universal, PNP like serial topology to interconnect various internal components within a gaming machine. Neither do any of the references teach or suggest the connection of a secondary game to the gaming machine using the universal serial PNP like topology.

It is therefore an object of the invention to provided a universal serial interconnection strategy for use in interconnecting internal gaming machine components.

It is another object of the invention to provide a universal serial interconnection strategy wherein machine components from different manufacturers could be readily interconnected.

It is also an object of the invention to provide a universal serial interconnection strategy wherein external machine components could likewise be interconnected with internal gaming machine components.

It is a further object of the invention to provide a universal serial interconnection strategy wherein one or more controllers automatically recognize the presence of each individual internal or external gaming machine component.

It is an additional object of the invention to provide a universal serial interconnection strategy wherein each gaming machine component presented for recognition includes a globally unique identification number (GUIN) to facilitate recognition by a controller.

It is a still further object of the invention to provide a universal serial interconnection strategy wherein, upon recognition of a particular GUIN, a controller may automatically re-configure itself or another programable portion of the gaming machine for communication with the device associated with the GUIN.

SUMMARY OF THE INVENTION

The present invention features a universal serial interconnection strategy which allows individual internal gaming machine components to be connected to a controller. Each component bears a globally unique identification number (GUIN) which allows the controller to recognize the device and to re-configure itself or another programmable component for proper communication with the device having the particular GUIN. In addition to internal gaming machine components, external components such as secondary or tertiary games may also be connected to a controller within a gaming machine to which the games are attached. The universal serial interconnection strategy of the invention thereby provides a "Plug-and-Play" (PNP) style interface which can eliminate the point-to-point interconnection of gaming machine components used in gaming machine of the prior art.

BRIEF DESCRIPTION OF THE DRAWINGS

A complete understanding of the present invention may be obtained by reference to the accompanying drawings, when taken in conjunction with the detail description thereof and in which.

DESCRIPTION OF THE PREFERRED EMBODIMENT

Generally speaking this invention relates to a system for interconnecting the internal components of a gaming machine.

Figure 1:
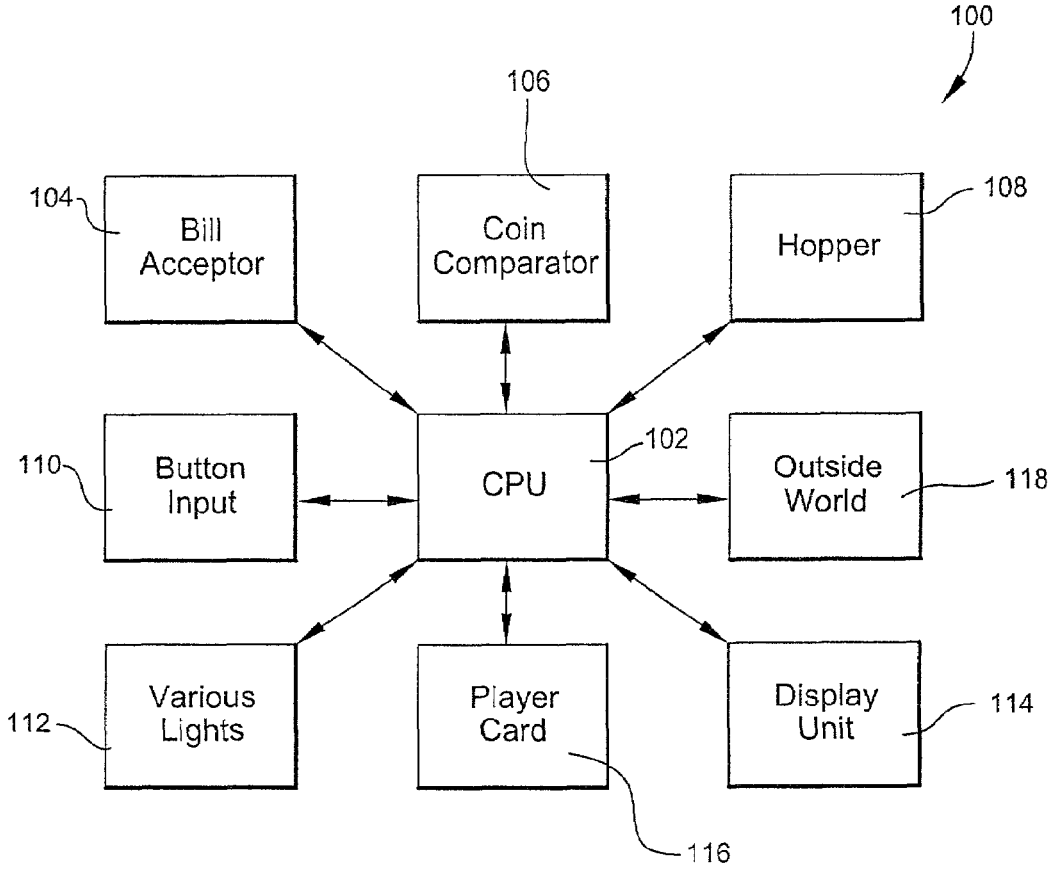
Fig. 1 PRIOR ART
FIG. 1 is a schematic block diagram of the internal wiring of a typical gaming machine of the prior art.

Referring first to FIG. 1, there is shown a schematic block diagram of a typical gaming machine of the prior art having internal components connected in a point-to-point manner, generally at reference number 100. A CPU 102 represents any type of controller, microprocessor or similar device well known in the art suitable for functioning as a controller for a gaming machine. A bill acceptor 104, coin comparator 106, a hopper 108, a button controller 110, a light controller 112, a display unit 114, a player card 116 are each shown connected directly to CPU 102. While these particular gaming machine components have been chosen for purposes of disclosure, it will be recognized by those skilled in the gaming machine design art that not all the disclosed components will necessarily be present in any particular gaming machine, some of the disclosed components such as player card 116 may be optional, and that many other components could be added to any design. The invention is not, therefore, considered limited to the particular mix of components chosen for purposes of disclosure.

A block labeled "outside world" represents a myriad of possible connections, devices, interfaces, etc. to which a gaming machine might be connected. This could include a network connection, a secondary machine or, in the case of a secondary machine, this could represent the connection to the host machine 100. However, regardless of the component or outside world connection 118, each component is typically connected to a CPU (not shown) using a proprietary interface. Each time a new gaming machine is designed, each component will probably require a new interface design to work with a new CPU 102 and/or in concert with a different mix of components. The point-to-point design of the prior art is, from a design and design verification perspective, inefficient. These point-to-point designs also make it difficult to add third-party add-on components or devices, either within the machine covers or external to the machine.

Figure 2:
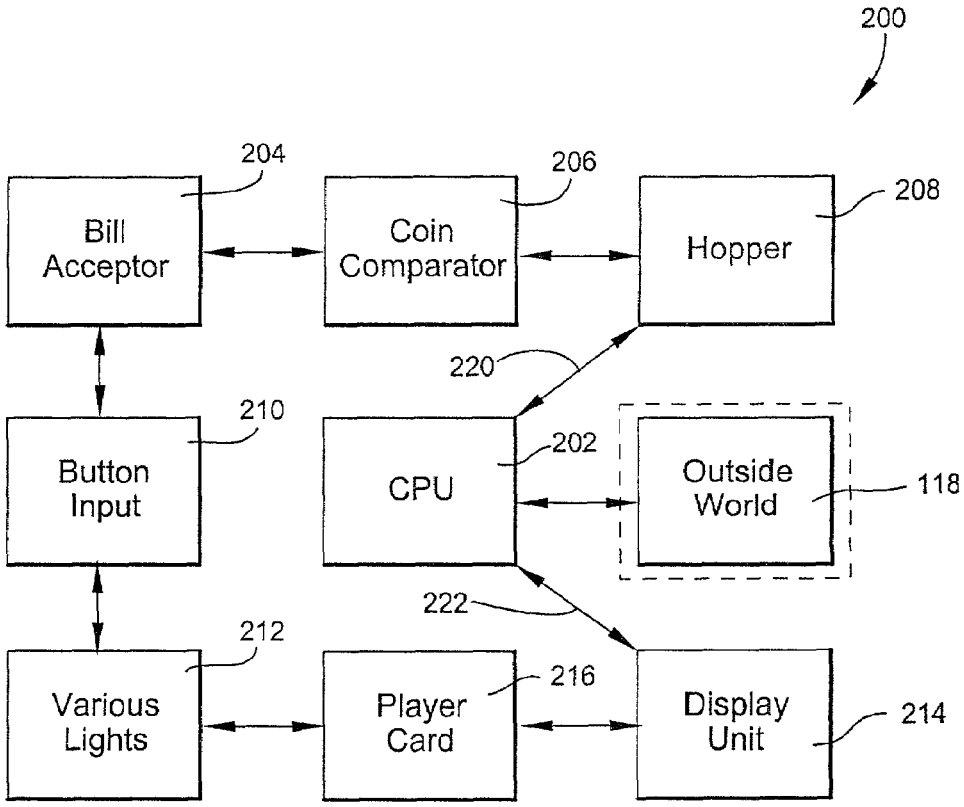
FIG. 2 is a schematic block diagram of the internal wiring of a typical gaming machine using the serial interconnection method of the invention implemented in a ring topology.

Referring now to FIG. 2, there is shown a schematic block diagram of a gaming machine 200 having identical components to those of the gaming machine of FIG. 1. However, each component is interfaced to a serial network. Schematically, the connection between CPU 202 and hopper 208 is also shown as a bi-directional serial connection 220. Likewise, the connection between CPU 202 and display unit 214 is shown schematically as another bi-directional serial connection 222. Hopper 208 is then daisy chained to coin comparator 206 which is, in turn, daisy chained to bill acceptor 204. Button controller 210, light controller 212, player card 216 and display unit 214. Daisy chaining interconnection of devices such as the gaming machine components disclosed on a serial bus is well known to those skilled in the serial communications art.

Figure 3:
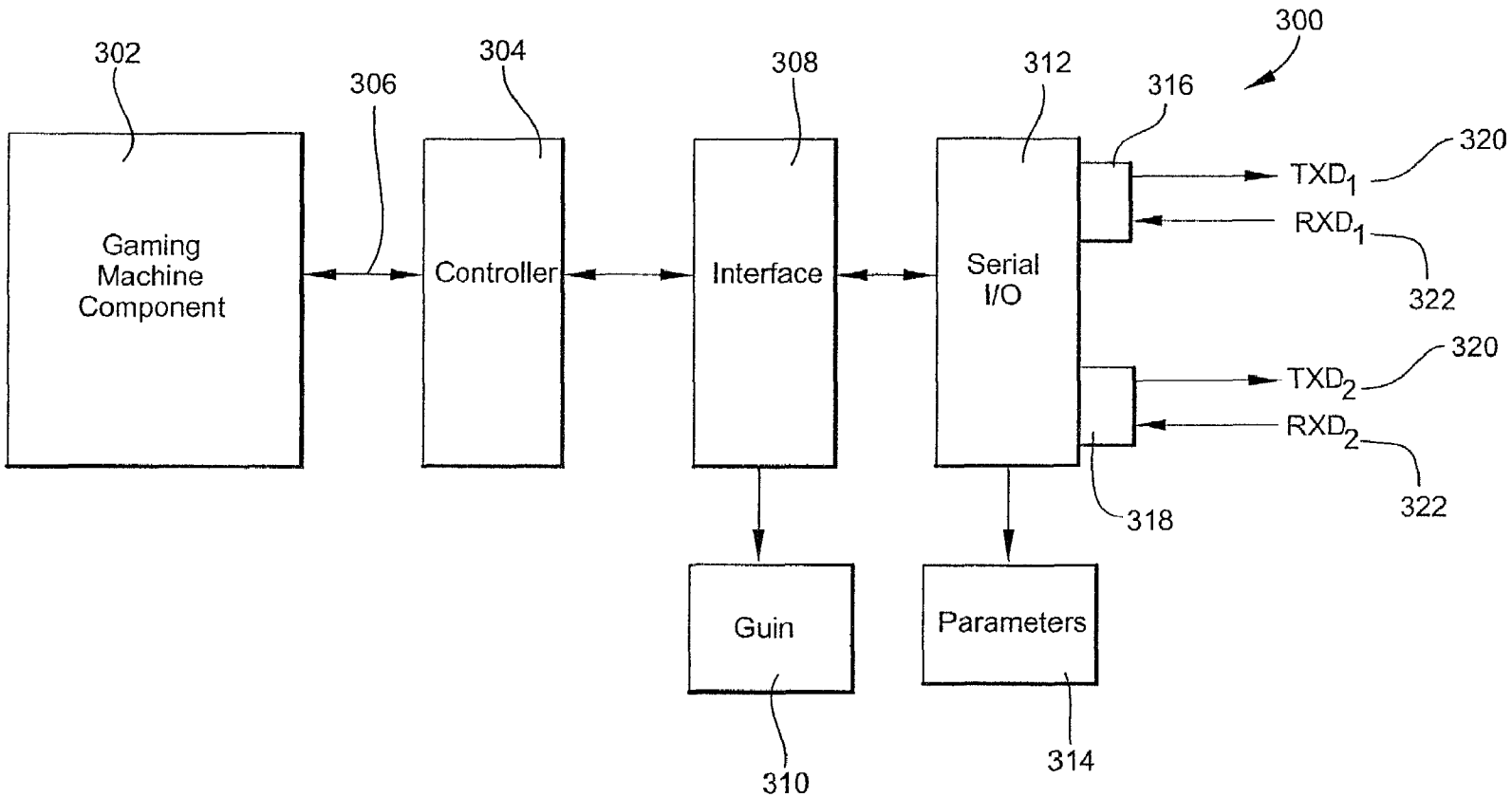
FIG. 3 is a schematic diagram of a generalized component equipped with a standard universal serial interface in accordance with the invention.

The use of an interconnection topology such as that of FIG. 2 presupposes that each component, sub-system, or game is equipped with a serial interface. The serial interface may be one of the standard, well known interfaces or, alternately, a proprietary interface. Referring now to FIG. 3, there is shown a schematic block diagram of a generalized sub-system (i.e., component) 300, adapted to work in a topology such as that of FIG. 2. A raw machine component 302 is shown connected to an on-board controller 304 by a bi-directional bus 306. The raw machine component 302 represents any device or mechanism which could conceivably be used within a gaming machine. Typical examples include motors, mechanical actuators, displays, sound generators, bill acceptors, payout devices, network interfaces, coin comparators, switch and button interface devices, light/lamp drivers, player cards, etc. It will be recognized by those skilled in the gaming machine arts that many other device exist or could in the future exist that could be used cooperatively within a gaming machine and the invention is not considered limited to those devices chosen for purposes of disclosure. Each component 302 is connected to its controller 304 across a device-specific bus connection 306. Controller 304 is assumed to include all necessary components or circuits required to operate component 302. For example, if component 302 is a stepper motor, the necessary power supplies and motor drive circuits are assumed embedded in controller 304. Controller 304 is connected to interface 308. In should be recognized that functions performed by interface 308 could, in alternate embodiments, be incorporated in controller 304. Interface 308 is connected to an address generation device 310. Address generation device 310 is programmed to provide the globally unique identification number (GUIN) which identifies component/sub-system 300 to the world. Many ways to generate a fixed address (e.g., the GUIN) are well known and any suitable method may be used in address generation unit 310. Interface 308 is connected to serial I/O device 312 which contains the necessary circuitry to format the received and transmitted data from and to the standard form used on the serial network. Serial I/O device 312 is typically implemented as a Universal Asynchronous Receiver/Transmitter (UART). UARTs are also well known to those of skill in the data communications arts. Data communications parameters are supplied to serial I/O device 312 from parameter storage device 314. Such parameters as data transmission speed, parity method, number of stop bits, number of data bits, etc. may all be provided from parameter storage device 314. Connectors 316 and 318 provide for connecting sub-system 300 to the serial network. The pair of connectors 316, 318 is adapted for daisy chain deployment of sub-system 300 as shown in the topology of FIG. 2. Each connector provides TxD and RxD data lines 220, 222, respectively as is well known in the data communications art. It will be recognized that additional lines for implementing hardware handshaking, for example Data Terminal Ready (DTR), Request-to-Send/Clear-to-Send (RTS/CTS) or Data Set Ready (DSR), etc. could be added to provide hardware handshaking. In the serial network topology as shown in FIG. 2, it is likely that software handshaking such as ETX/ACK or XON/XOFF could be used rather than hardware handshaking. The aforementioned line names are defined in the RS232 standard. Other line names and/or function may be provided in other serial data communications standards.

In operation, the generalized gaming machine sub-system 300 is adapted to receive (and, as required, transmit) instructions and/data in a standard format from the serial network (not shown) through serial I/O 312 and interface 308. Controller 304 converts these instructions and data into the necessary, device-specific form to communicate with each raw machine component 302. Any controller such as CPU 202 (FIG. 2) has recognized the GUIN of component 300 and as sent instructions and/or data in a format usable by the device based on CPU 202's "understanding" of component 300 obtained from its GUIN.

Figure 4A:
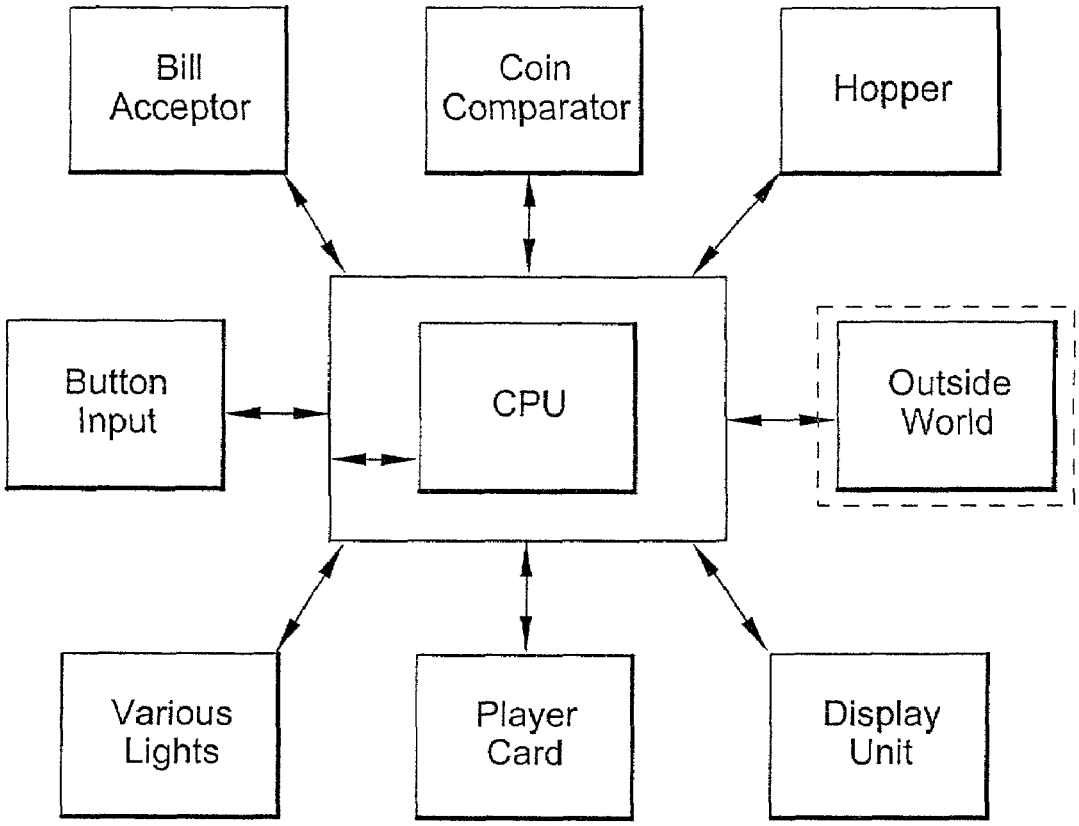
FIG. 4*a* is a schematic block diagram of the internal wiring of a typical gaming machine using the serial interconnection method of the invention implemented using a bus network topology.
Figure 4B:
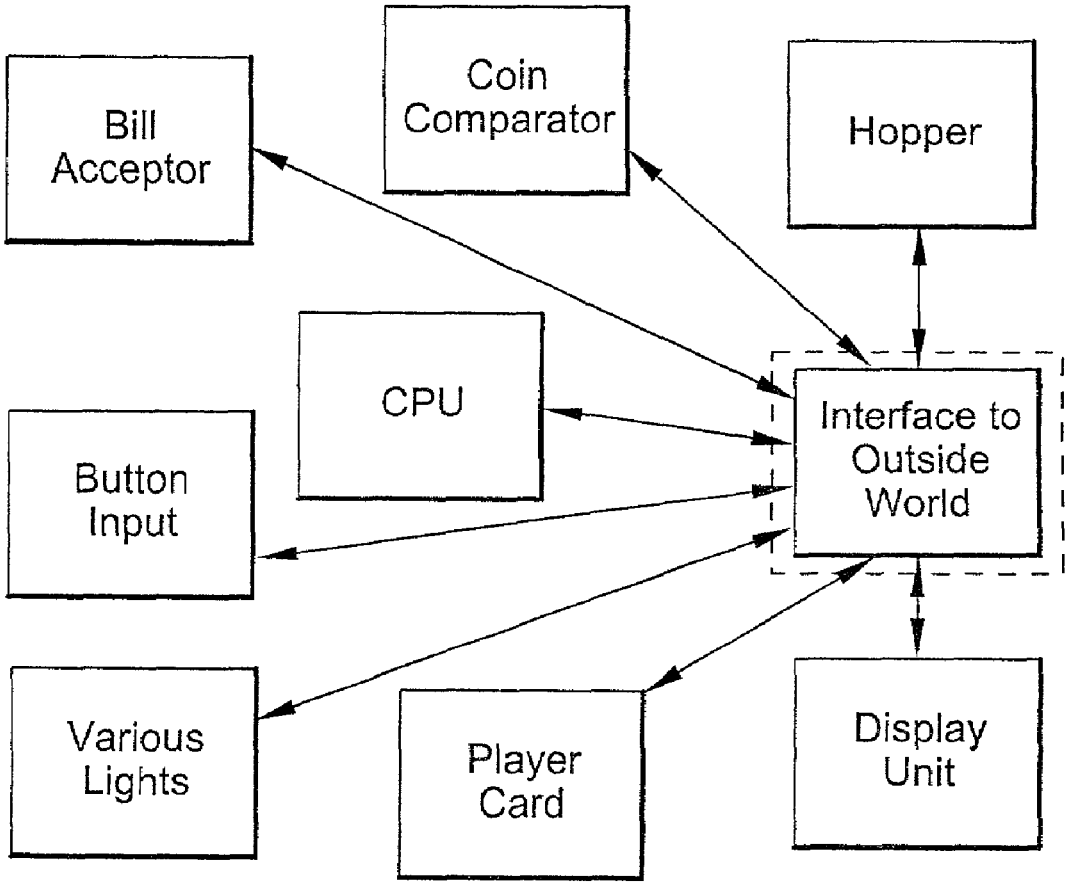
FIG. 4*b* is a schematic block diagram of the internal wiring of a typical gaming machine using the serial interconnection method of the invention implemented in a star network topology.
Figure 4C:
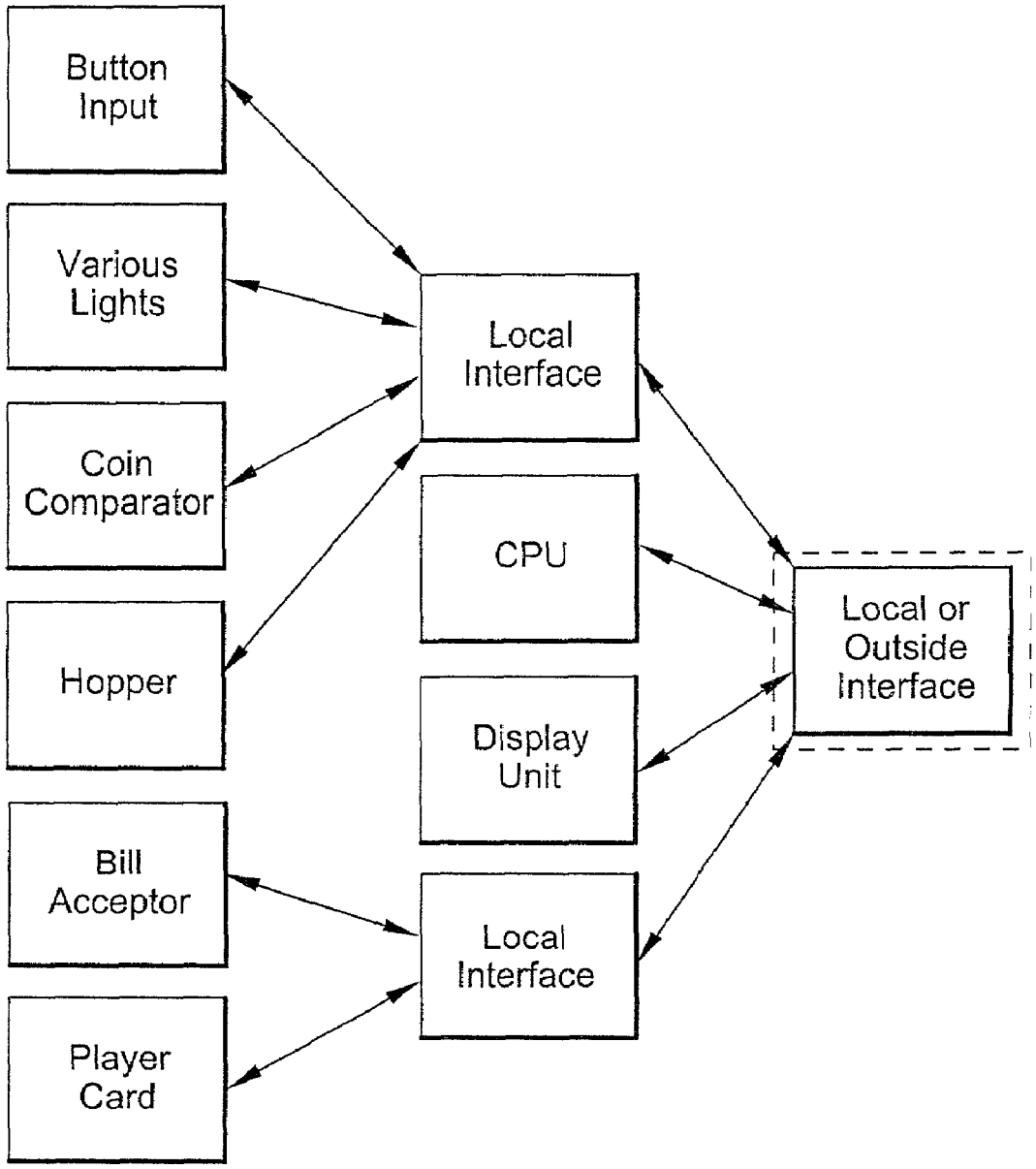
FIG. 4*c* is a schematic block diagram of the internal wiring of a typical gaming machine using the serial interconnection method of the invention implemented in a tree network topology.

Referring now to FIGS. 4*a*, 4*b* and 4*c*, there are shown alternate embodiments of a serial interconnection strategies suitable for use in a gaming or similar type machine. FIG. 4*a* shows a bus topology, FIG. 4*b* a star topology and FIG. 4*c* a tree topology. Each topology has its advantages and disadvantages, well known to those skilled in the serial data communication art. Each of these topologies has its unique connection requirements, such specific connection requirements being beyond the scope of the instant invention and forming no part thereof. It will be recognized that there may be other interconnection topologies possible and the concepts of the instant invention are deemed applicable to those topologies as well as those shown for purposes of disclosure.

Figure 5:
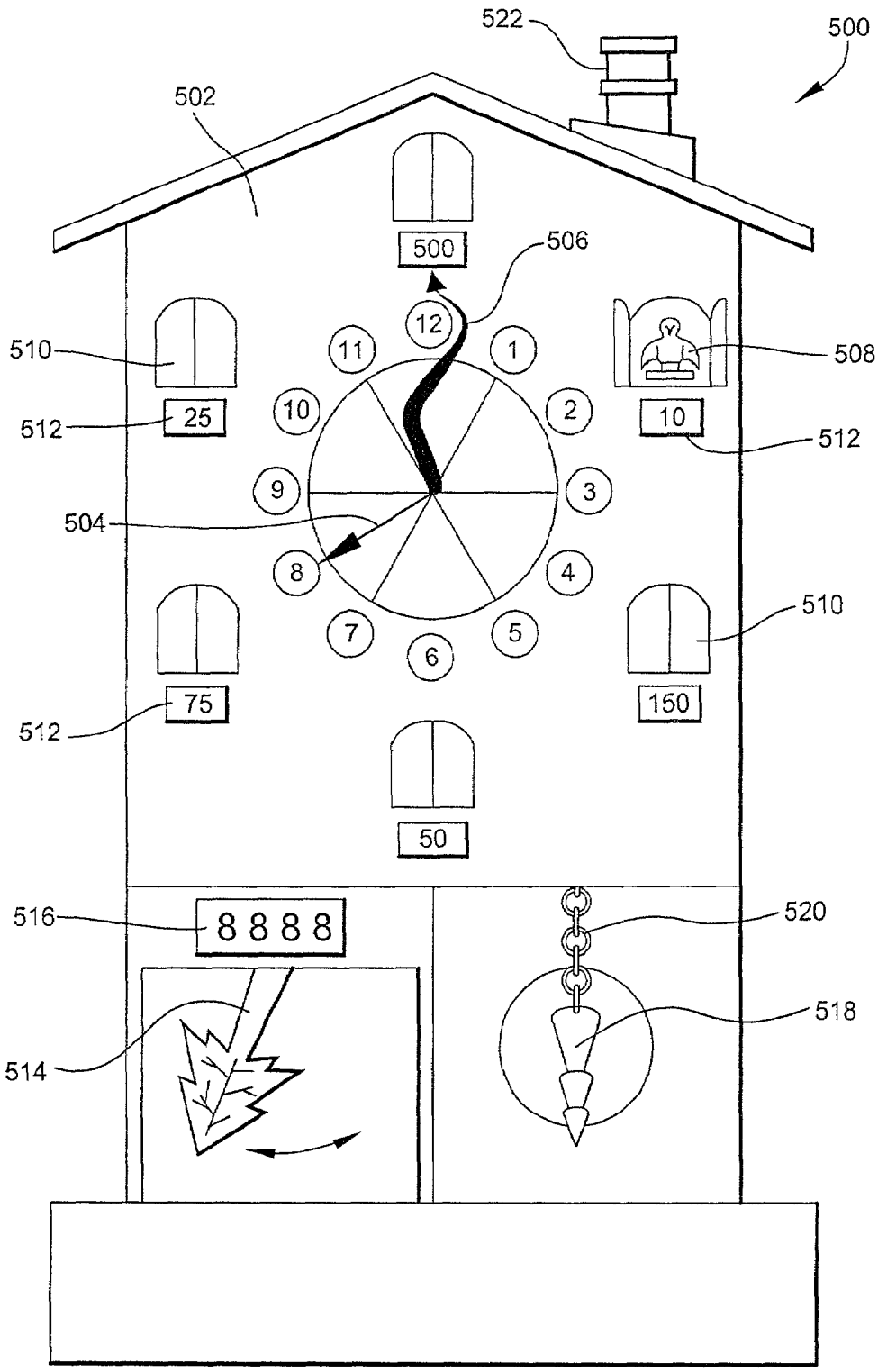
FIG. 5 is a schematic view of the face of a typical gaming machine wherein the serial interconnection method of the invention has been implemented.

Referring now to FIG. 5, there is shown a front elevational schematic view of a particular gaming machine 500 found suitable for implementing the inventive interconnection strategy. The gaming machine 500 is called, for obvious reasons, "Cuckoo Clock". While gaming machine 500 is intended as a secondary game operating cooperatively with a primary game such as a slot machine (conventional or electronic), video poker game, etc., the component interconnection principles disclosed are applicable to primary gaming machines as well.

The face 502 of gaming machine 500 (i.e., the game) shows the portions presented to a player of the various gaming machine components which make up the Cuckoo Clock game 500. The game is styled in a similar fashion to a Black Forest cuckoo clock and has a pair of hands (i.e., hour hand 504 and minute hand 506), each rotationally independent from one another. Hands 504, 506 are attached, via concentric shafts (not shown), to stepper motors (not shown) so that they may be independently rotated by their respective stepper motors. Six mechanically-actuated cuckoo birds 508 are housed behind openable doors 510. Selectively illuminatable, indicia-bearing displays, lamps or light segments 512 are placed beneath each openable door 510. A servo actuated pendulum 514 is shown near the lower left corner of face 502. Upon actuation, pendulum 514 swings back and forth in a motion similar to the pendulum in a real cuckoo clock. A credit totalizer numerical display 516 keeps a cumulative score or point count for game 500. A pull-to-activate counterweight 518 attached to a chain 520 is used to actuate game 500. A player wishing to activate game 500 grasps weight 518 and pulls the chain 520 attached to weight 518 downward. An internal switch (not shown), operatively connected to the chain reacts to the pulled chain 520 by activating game 500. It will be recognized that alternative ways to activate game 500 other than a switch activated by chain 520 may also be provided as required by a particular operating circumstance or environment. A traditional candle lamp 522 placed atop game 500 is used for signaling a jackpot or some other game condition. In addition, candle lamp 522 may be used to signal an operator on the floor of the casino that attention is required at the machine.

The internal components of game 500 consist of: two stepper motors (not shown) connected to the clock hand 504, 506; six mechanically actuated birds 508, 24 individual lights or light sections 512, a servo-controlled or motor-controlled pendulum 514, a pull-to-activate counterweight 518, a numeric display 516 and an internal sound card and speaker (not shown). One of the unique features of game 500 is that each of the aforementioned individually actuated internal components contains its own microprocessor or controller 202 (FIG. 2) and, each component is communicatively linked to each other component via an internal serial network. This serial-linked architecture allows reconfiguration of individual machine components into new game configurations with very little effort. In addition to being individually controlled and serial linked, each internal machine component has a pre-programmed, globally unique identification number (GUIN) built in. The central processor may thus detect, identify, enumerate, authenticate and configure each of the individual components. The overall game may thus be automatically configured according to the particular mix of internal components. Through judicious choice of the GUINs assigned, machine tampering or fraud through unauthorized machine reconfiguration may be greatly reduced.

Because gaming machine 500 is assembled from well defined, previously evaluated components, the amount of time required to have the game evaluated and accepted by gaming authorities will also be reduced.

In addition to communicatively connecting the internal components, the same serial network may be used to connect the game 500 to the outside world. In the example chosen for purposes of disclosure, gaming machine 500 is a secondary game. The innovative interconnection strategy is equally applicable to any gaming machine, whether primary, secondary, tertiary, etc. In addition, the same design principles could readily be applied to other fields of endeavor wherever disparate components and/or sub-systems must be combined into a system and the components must communicate to a controller an/or each other.

While a central processor has been disclosed within a particular gaming machine, it will be recognized that the function(s) performed by an internal controller could easily be provided external to the gaming machine, communication between the external controller and the gaming machine components being by the serial network. This kind of arrangement would be particularly useful in a secondary/tertiary gaming machine where controller function could be provided, for example, by the primary game.

Since other modifications and changes varied to fit a particular operating requirement and environment will be apparent to those skilled in the art, the invention is not considered limited to the example chosen for purposes of disclosure, and covers all changes and modifications which do not constitute a departure from the true spirit and scope 15 of the invention.

Having thus described the invention, what is desired to be protected by Letters Patent is presented in the subsequent appended claims.

What is claimed is:

1. A system for interconnecting components in a gaming machine comprising:

a) a central controller having an input/output (I/O) section adapted for two-way communication with a serial communications means;

b) the serial communications means operatively connected to said I/O section of said central controller;

c) a plurality of gaming machine components, each gaming machine component being individually actuated and comprises its own on-board controller for electrical communications with said serial communications means and a globally unique identification number (GUIN);

whereby said central controller automatically detects the presence of each respective one of said plurality of gaming machine components and said GUIN associated with said each gaming machine component identifies said each gaming machine component to said central controller and said central controller performs at least one configuration task responsive to said GUIN associated with said each gaming machine component; and wherein said gaming machine is a secondary game gaming machine adapted to be coupled to a primary game gaming machine and said secondary game gaming machine is a cuckoo clock game.

2. The system for interconnecting components in a gaming machine as recited in claim 1, wherein said primary game gaming machine is one of a slot machine and a video poker game.

3. The system for interconnecting components in a gaming machine as recited in claim 1, wherein said cuckoo clock game comprises an hour hand and a minute hand, each rotationally independent of each other.

4. The system for interconnecting components in a gaming machine as recited in claim 3, wherein said cuckoo clock game further comprises:

a plurality of mechanically-actuated cuckoo birds housed behind openable doors;

selectively illuminatable displays placed beneath each openable door;

a servo actuated pendulum which swings back and forth in a motion.

* * * * *